US009722311B2

(12) United States Patent
Huang et al.

(10) Patent No.: US 9,722,311 B2
(45) Date of Patent: Aug. 1, 2017

(54) ANTENNA DEVICE WITH CONTINUOUS BENDING STRUCTURE AND APPLICATION SYSTEM USING THE SAME

(71) Applicant: ARCADYAN TECHNOLOGY CORPORATION, Hsinchu (TW)

(72) Inventors: Chih-Yung Huang, Taichung (TW); Kuo-Chang Lo, Miaoli County (TW)

(73) Assignee: ARCADYAN TECHNOLOGY CORPORATION, Hsinchu (TW)

( * ) Notice: Subject to any disclaimer, the term of this patent is extended or adjusted under 35 U.S.C. 154(b) by 29 days.

(21) Appl. No.: 15/054,635

(22) Filed: Feb. 26, 2016

(65) Prior Publication Data

US 2017/0162939 A1 Jun. 8, 2017

(30) Foreign Application Priority Data

Dec. 7, 2015 (TW) ..... 104140931 A

(51) Int. Cl.
*H01Q 1/24* (2006.01)
*H01Q 5/10* (2015.01)
*H01Q 1/38* (2006.01)

(52) U.S. Cl.
CPC ..... *H01Q 5/10* (2015.01); *H01Q 1/38* (2013.01)

(58) Field of Classification Search
CPC ..... H01Q 1/243; H01Q 5/371; H01Q 5/378; H01Q 9/0421; H01Q 1/38; H01Q 21/24
USPC ..... 343/700 MS, 702, 829, 846
See application file for complete search history.

(56) References Cited

U.S. PATENT DOCUMENTS

| | | | | |
|---|---|---|---|---|
| 7,626,551 | B2 * | 12/2009 | Chien | H01Q 9/0421 343/700 MS |
| 7,903,035 | B2 * | 3/2011 | Mikkola | H01Q 1/243 343/700 MS |
| 9,276,311 | B2 * | 3/2016 | Chow | H01Q 1/38 |
| 9,437,925 | B2 * | 9/2016 | Wong | H01Q 5/371 |
| 2010/0066612 | A1 * | 3/2010 | Tai | H01Q 1/36 343/700 MS |
| 2013/0241777 | A1 | 9/2013 | Change et al. | |
| 2014/0256388 | A1 | 9/2014 | Lin et al. | |

FOREIGN PATENT DOCUMENTS

| | | | |
|---|---|---|---|
| TW | M395275 | U1 | 12/2010 |
| TW | 201138216 | A1 | 11/2011 |
| TW | 201203687 | A1 | 1/2012 |

* cited by examiner

*Primary Examiner* — Tho G Phan
(74) *Attorney, Agent, or Firm* — Li & Cai Intellectual Property (USA) Office

(57) ABSTRACT

The disclosure is related to an antenna device with continuous bending structure using the antenna. The radiation body of the antenna device includes a main region having at least three L-type continuous bending structures, and a ground region having at least one L-type bending structure. Two adjacent sides of the planar structure of the antenna device render an aspect ratio of approximately one to one. A signal feeding point and a signal grounding point are formed upon the main region. The two points are connected over a wire for forming a signal-feeding direction. According to a demand, the aspect of the present invention allows for modifying the signaling direction of the antenna by adjusting the mounting angle in an electronic device so as to modify the direction of radiation field intensity of the electronic device.

14 Claims, 10 Drawing Sheets

ANTENNA DEVICE WITH CONTINUOUS BENDING STRUCTURE AND APPLICATION SYSTEM USING THE SAME

BACKGROUND OF THE INVENTION

1. Field of the Invention

The present invention is related to an antenna device and a system, in particular to the antenna device with continuous bending structure, making it easy to tune its radiation field intensity, and its application system.

2. Description of Related Art

In the modern telecommunication technology, many thin and small-sized antennas have been developed for applications in various handy electronic devices. For example, a planar inverted-F (PIFA) antenna is an ordinary type to be mounted on an inner wall of the electronic device when the device is required to be thinner and have better performance. According to the conventional technology, a co-axial cable is provided to couple to a signal feeding point and a signal grounding point of PIFA using an inner conductor and an outer conductor respectively. PIFA then radiates the electromagnetic wave.

However, the conventional kinds of the antennas may not easily be adapted to other devices when they are designed for the proprietary applications. For example, the antenna may be required to have longer shape or size for complying with specific frequency of operation, or the difference between the long side and short side of the antenna may be too large to fit in many devices. Further, in some applications, the conventional antenna needs to occupy a larger space. In other words, the conventional planar inverted-F antenna with a longer side and a shorter side is not easily disposed to devices with limited space for the antenna when it is required to adjust its position and angle within such devices. Furthermore, it is hard to optimize the radiation field by adjusting the position and angle of the antenna when the antenna is mounted within the device.

SUMMARY OF THE INVENTION

The disclosure of the present invention is regarding an antenna device with continuous bending structure and an application system thereof. Since the position and angle of the conventional planar inverted-F antenna may not be easily adjusted for fitting in an electronic device, provision in the present invention is to an antenna device being characterized in that an aspect ratio thereof is approximately one to one. This structure with aspect ratio of approximately one to one allows the antenna device to be positioned to a specific position of the electronic device conveniently, and further, the position and angle of the antenna device can be easily adjusted as required.

In one embodiment of the present invention, the radiation body of the antenna device with continuous bending structure can be recognized as the several extensions including a first radiation member, a second radiation member, a third radiation member, a fourth radiation member, and a fifth radiation member. Two adjacent radiation members form a bending structure, and all the bending structures of the antenna devices have consistent bending directions. The two end sides of the radiation members, e.g. the first and the fifth radiation members, are not connected. The first end bending member is directed toward the fourth radiation member.

The main region of the antenna device has at least three L-shaped continuous bending structures including the first radiation member, the second radiation member, the third radiation member, and part of the fourth radiation member. The fourth radiation member has a signal grounding point. The first radiation member has a signal feeding point. The ground region of the antenna device includes at least one L-shaped bending structure covering the fifth radiation member and another part of the fourth radiation member.

According to one further embodiment, the aspect ratio of the two adjacent sides of the planar structure of the antenna device is an approximately one to one aspect ratio. The two adjacent sides exemplarily indicate the sides of the third radiation member and the fourth radiation member.

The signal feeding point of the main region is connected with the signal grounding point via a wire. The connectivity between the signal feeding point and the signal grounding point forms a signal-feeding direction. If the signal-feeding direction is over a horizontal direction of an electronic device having the antenna device, the polarization over the horizontal direction can be strengthened and a radiation field intensity of the device is primarily developed along the horizontal direction. On the contrary, if the signal-feeding direction is over a vertical direction, radiation field intensity is developed along the vertical direction. This means the polarization along the vertical direction is strengthened.

In one embodiment, the antenna device is characterized in that the operating frequency for the antenna device can be tuned by adjusting the signal feeding position or angle of the antenna since the adjustment changes the radiation length. That means the operating frequency of the antenna can be changed by adjusting the signal direction from the signal grounding point to the signal feeding point of the antenna device.

DETAILED DESCRIPTION OF THE PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

The disclosure is related to an antenna device with continuous bending structure and an application system thereof. The structure specified for the antenna device makes it easier to be optimized within an apparatus, including adjusting its position and angle for fitting in with the apparatus. The antenna device is characterized in that an aspect ratio thereof is approximately one to one. In addition to conveniently disposing the antenna at a position in an electronic device, the position of the antenna can be adjusted for the purpose of optimization, and in particular the angle of the antenna can also be easily adjusted since the aspect ratio is configured to be approximately one to one (1:1).

Figure 1:
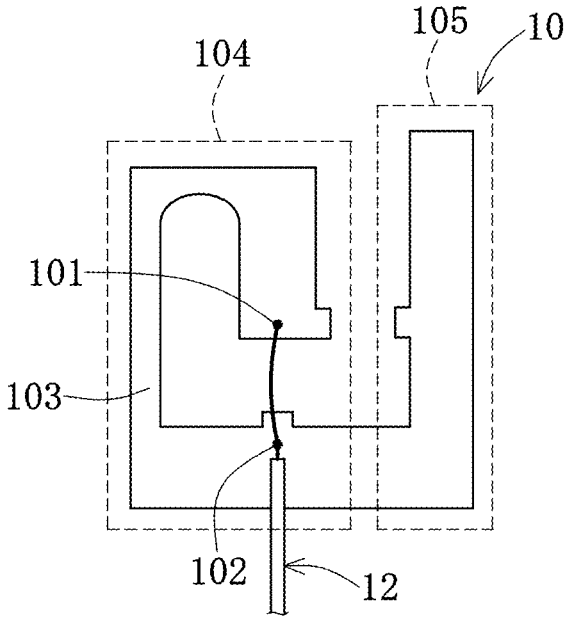
FIG. 1 shows a schematic diagram depicting the antenna device with continuous bending structure according to one embodiment of the present invention.

In an aspect of the antenna device, the length from the signal feeding point to the grounding portion is about a half length of the resonance wavelength of the operating frequency of the antenna. This design allows the radiation body of the antenna to be the radiation body for the specific frequency. In particular, when the aspect ratio of the long side and the short side of the antenna device is configured to be approximately 1:1, it is conveniently used in an electronic device. The antenna device can be used to specify a direction of the radiation field intensity by adjusting its orientation, e.g. 90-degree angular position. The approximately one to one aspect ratio allows the antenna device to change its angular position for fitting with use of the electronic device. Reference is made to FIG. 1 schematically depicting the antenna device in one embodiment of the present invention.

In this schematic diagram, an antenna device 10 with continuous bending structure is disclosed. The antenna device 10 is configured to be a planar structure. A wire 21, e.g. inner conductor or outer conductor of a coaxial cable, is used to feed signals into the antenna device via a signal feeding point 101. Another point of the antenna device is a signal grounding point 102 within a main region 104 electrically connected to a radiation body 103. The main region 104 essentially includes at least three L-shaped continuous bending structures over the radiation body. A wire interconnects the signal feeding point 101 and the signal grounding point 102, and the wire can be an extension of the wire 12.

Another half portion of the radiation body 103 acts as a ground region 105 of the antenna. This half portion includes at least one L-shaped bending structure within the radiation body. One of the characteristics of the antenna device 10 is to alter the signaling path and direction by changing the signal feeding position. The operating frequency is modifiable and the direction of the radiation field intensity is also changeable when the signaling direction is modified. It is noted that the signal feeding point 101 or the signal grounding point 102 can be a connection region occupying an area of the radiation body.

According to the antenna device 10 schematically shown in the diagram, the wire 12 is electrically connected to the signal feeding point 101, and bridged to the signal grounding point 102. The radiation body of the antenna device is defined from the signal feeding point 101 to the extension portion with an approximately 90-degree bending in a predefined length. The radiation body extends another predefined length with an approximately 90-degree bending. The main region 104 shown in FIG. 1 includes three bending structures. The whole structure of the antenna device 10 may include multiple bending structures. The antenna device 10 overall may include four bending structures if it adds the one more bending of the ground region 105. The antenna device 10 with the continuous bending structure is therefore provided.

Figure 2:
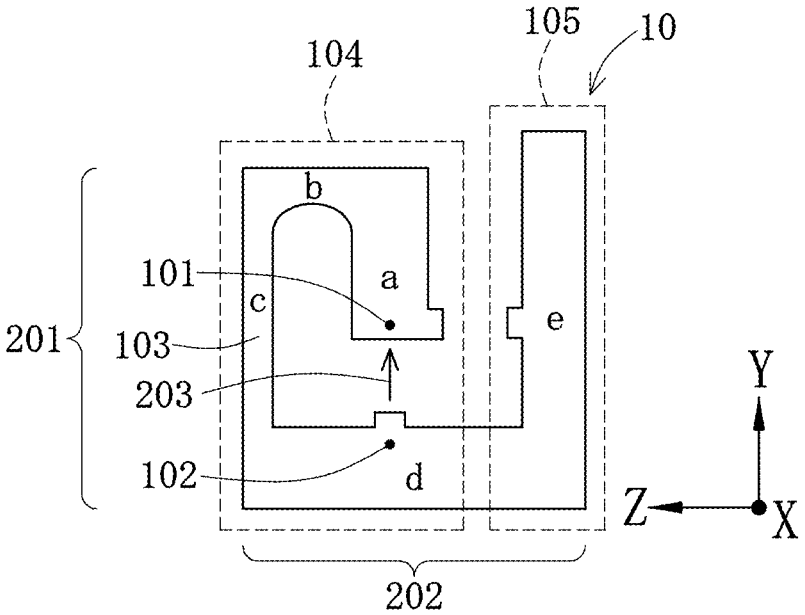
FIG. 2 shows a diagram exemplarily depicting the antenna with the continuous bending structure in one embodiment of the present invention.

FIG. 2 shows another schematic diagram of the antenna device according to one embodiment of the present invention.

The antenna device 10 with continuous bending structure is disclosed. The bending structure can be roughly divided into a first radiation member 'a', a second radiation member 'b', a third radiation member 'c', a fourth radiation member 'd' and a fifth radiation member 'e'. Every radiation member forms a rectangular radiation body. The junction region between two adjacent radiation members forms a bending structure. An approximately 90-degree L-shaped bending structure is disclosed. A bending portion exists between the first radiation member 'a' and the second radiation member 'b'. Another bending portion exists between the second radiation member 'b' and the third radiation member 'c'. One further bending portion is between the third radiation member 'c' and the fourth radiation member 'd'. One more bending portion is formed at the junction between the fourth radiation member 'd' and the fifth radiation member 'e'. There are four main bending portions in the antenna device. The bending junction region between the radiation member 'a' and the radiation member 'b' causes the bending first radiation member 'a' to be directed toward to the fourth radiation member 'd', but not contact the fifth radiation member 'e' so a spacing between the first and fifth radiation members is formed. An overall convolution type of antenna is formed.

Some other embodiments are also provided since some secondary structures may be required for the purposes of frequency matching or soldering. More, the antenna may have further bending structures at some specific positions of the radiation body.

The radiation body 103 of the antenna device 10 may be divided into the main region 104 and the ground region 105. The main region 104 is a portion of the radiation body covering the first radiation member 'a', the second radiation member 'b', the third radiation member 'c', and a part of the fourth radiation member 'd' of the antenna device 10. The main region 104 includes at least three bending structures within the radiation body in the present embodiment.

In one embodiment, within the three L-shaped continuous bending structures of the main region 104, a signal grounding point 102 in the fourth radiation member 'd', and a signal feeding point 101 in the first radiation member 'a' are made. The junction region between the first radiation member 'a' and the second radiation member 'b' has an L-shaped bending structure. Further the junction region between the second radiation member 'b' and the third radiation member 'c' includes another L-shaped bending structure. Still further, the junction region between the third radiation member 'c' and the fourth radiation member 'd' has another L-shaped bending structure.

The ground region 105 covering the other part of the fourth radiation member 'd' and the fifth radiation member 'e' is another portion of the antenna device 10 besides the main region 104. The junction region there-between covers at least one L-shaped bending structure. The part of the fourth radiation member 'd' within the ground region 105 couples to the other part of the fourth radiation member 'd' within the main region 104.

In another embodiment of the invention, the first radiation member 'a', the third radiation member 'c' and the fifth radiation member 'e' are in parallel with each other. The first radiation member 'a' is in between the third radiation member 'c' and the fifth radiation member 'e'. However, the first radiation member 'a', the third radiation member 'c' and the fifth radiation member 'e' may also be non-parallel with each other and not intersect with each other. Further, the second radiation member 'b' and the fourth radiation member 'd' are disposed not only in parallel, but also non-parallel and do not intersect each other.

The two sides 201, 202 indicate the main radiation structure of the antenna device 10. The main region 104 includes a first side 201 which is one side of the third radiation member 'c', and a second side 202 which is one side of the fourth radiation member 'd'. Both the adjacent first side 201 and second side 202 form radiation structures that are approximately perpendicular to each other. In particular, the aspect ratio of the two planar sides 201, 202 is approximately one to one. That means the ratio of the first side 201 and the second side 202 is about 1:1.

The signal feeding point 101 within the first radiation member 'a' of the radiation body 103 is coupled across to the signal grounding point 102 within the fourth radiation member 'd'. The points 101 and 102 can be coupled via a wire and the connectivity there-between forms a signal-feeding direction, represented by an arrow indicative of a signaling direction 203. The electrical signals fed by an electronic device are directed to the antenna device 10 along this signaling direction 203. The signals can be fed from the signal grounding point 102 to the signal feeding point 101, and spread to the radiation member 'a' including the signal feeding point 101.

Figure 3A:
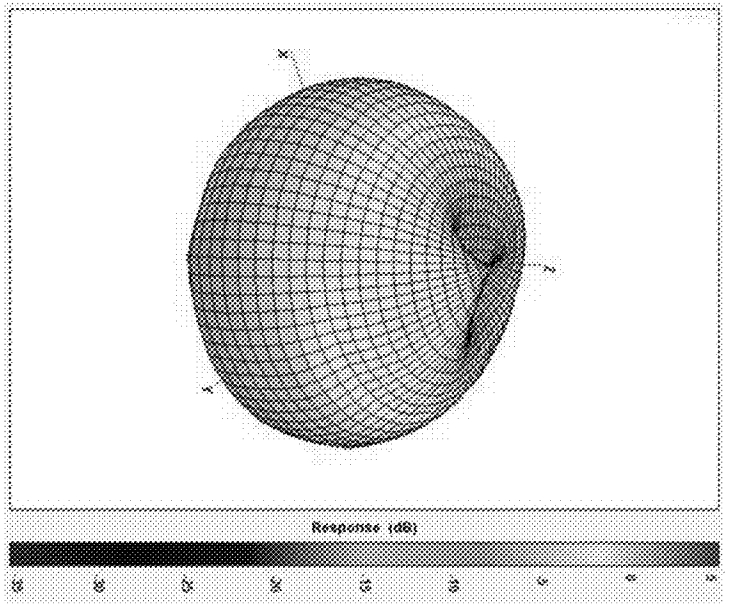
FIG. 3A and FIG. 3B show a diagram describing the performance of frequency response of the antenna device of the present invention.
Figure 3B:
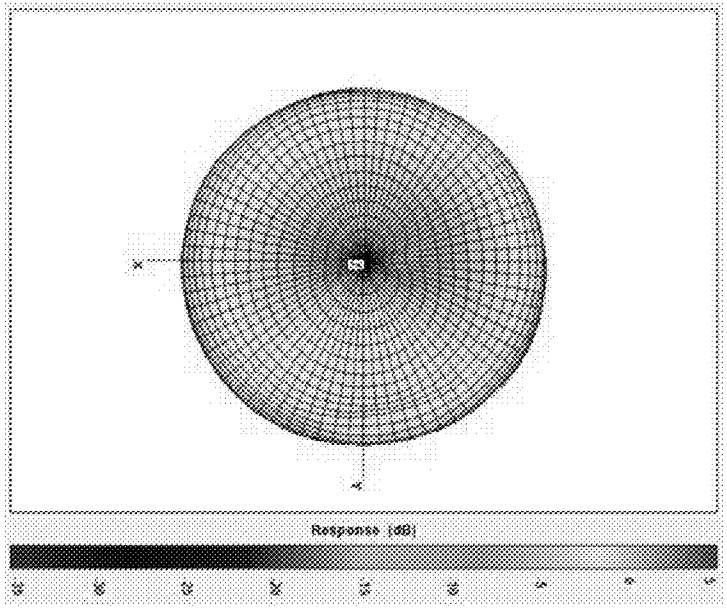

In an exemplary, the antenna device 10 is at coordinate system (X, Y, Z). The electrical signals are transmitted from the signal grounding point 102 to the signal feeding point 101, and therefore form the signaling direction 203, e.g. along the Y-direction in the present example. The Y-direction signaling direction 203 denotes strengthening horizontal polarization over the X-Y plane and forms a radiation field intensity essentially developed over the X-Y plane. Therefore, this configuration is adapted to the product which requires stronger horizontal radiation field intensity. The simulation diagrams of the radiation field intensity are shown in FIG. 3A and FIG. 3B. The connectivity of the points of the antenna device 10 forms the signaling direction 203 that causes fuller and more average radiation intensity over the X-Y plane. The intensity value along a coordinate axis shown in FIG. 3A and FIG. 3B indicates the frequency response (dB).

Figure 4:
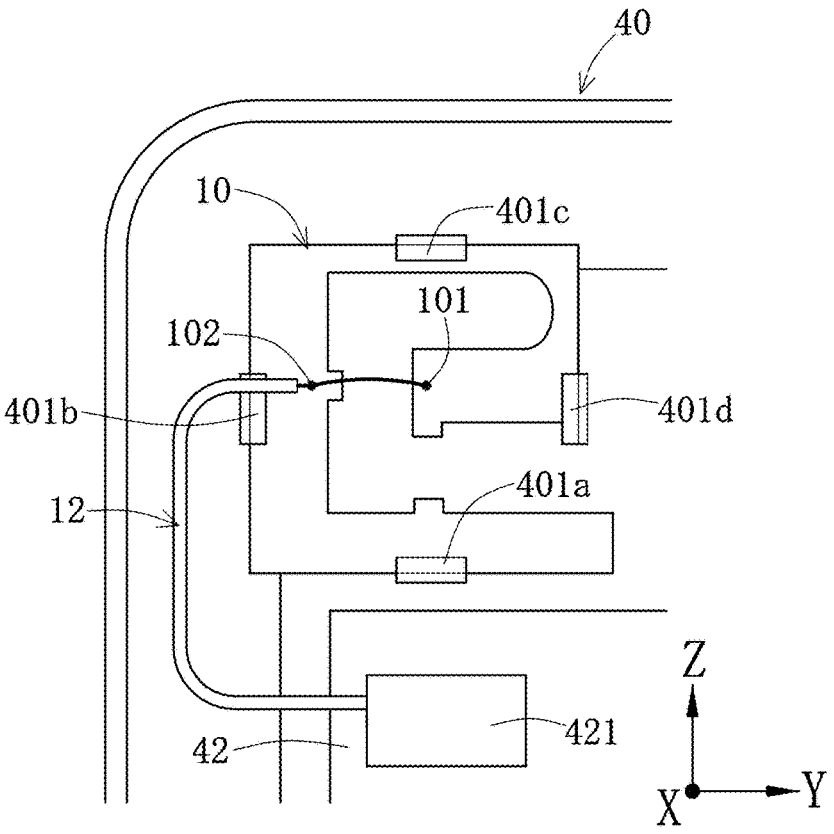
FIG. 4 shows a schematic diagram describing an apparatus mounting the antenna device with continuous bending structure in one embodiment of the present invention.

The antenna device 10 shown in FIG. 2 can be applied to an application system. The application system is such as an access point, or a router that considers directionality of the radiation field intensity of the antenna device with continuous bending structure. Reference is made to FIG. 4 depicting the system utilizing the antenna device in accordance with the present invention.

The application system shown in FIG. 4 includes the antenna device 10 with continuous bending structure and an electronic device adopting this antenna device 10. The antenna device 10 is disposed within a housing 40 of the electronic device. The antenna device 10 can be fixed at a position within the housing 40 using kinds of clamping members. The figure shows several clamping members such as the four fixing members 401*a*, 401*b*, 401*c* and 401*d*. According to an aspect of the present invention, the direction of the antenna device 10 can be adjusted. The kinds of clamping members are configured to mount the adjustable antenna device 10 within the same electronic device as needed. The clamping member applicable to the application system is not limited to the embodiment shown in the diagram.

In one embodiment, the signal feeding point and the signal grounding point are connected via a wire. The connectivity forms a signal-feeding direction. If the signal-feeding direction is configured to be along a horizontal direction of the electronic device, the radiation field intensity mainly developed over the horizontal direction is formed. If the signal-feeding direction is at vertical direction of the electronic device, the radiation field intensity over the vertical direction is formed. Thus the electronic device with the clamping member allows adjusting the signal-feeding direction of the antenna device 10 to be horizontal or vertical.

In the example shown in FIG. 4, the antenna device 10 is mounted within the housing 40 of the electronic device. The antenna device 10 is electrically coupled to a circuit board 42 via a wire 12. The circuit board 42 is such as a radio-frequency circuit 421 in charge of RF signals. The radio-frequency circuit 421 radiates signals through the antenna device 10 according to the application of the electronic device. The example shows the antenna device 10 is in the coordinate system (X, Y, Z) as shown in FIG. 2. Based on the coordinate system (X, Y, Z), the electrical signals are transmitted from the signal grounding point 102 to the signal feeding point 101, and form a radiation field intensity over the X-Y plane, that is the horizontal direction shown in the figure. That means the configuration of the antenna device 10 renders better radiation field intensity over the horizontal X-Y plane. The network device mounted with the antenna device 10 with the better horizontal radiation field intensity over the X-Y plane is suitable to be placed in a horizontal space which requires better horizontal radiation field intensity. The network device is such as a wireless access point, wireless router, or IP sharing machine.

Figure 5:
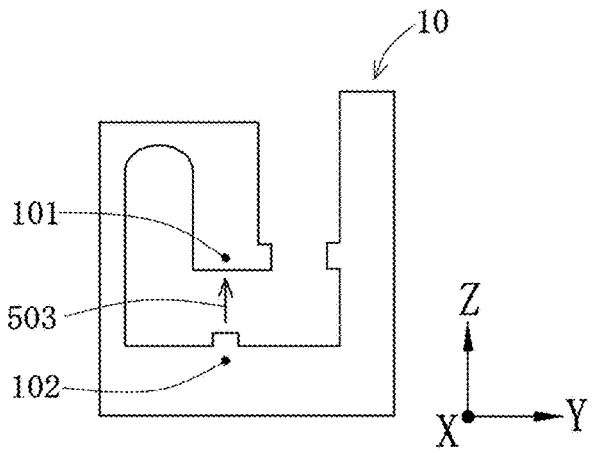
FIG. 5 shows a schematic diagram depicting the antenna device in one embodiment of the present invention.

In one further embodiment, reference is made to FIG. 5. The antenna device 10 is within another coordinate system (X, Y, Z) rather than the configuration shown in FIG. 2. The coordinate system shown in FIG. 5 is rotated with 90 degrees from the coordinate system shown in FIG. 2. The electrical signals are transmitted from the signal grounding point 102 to the signal feeding point 101, and the signaling direction 503 along Z direction is formed. Therefore radiation field intensity over X-Z plane is mainly developed, and used to strengthen the vertical polarization for achieving the stronger vertical radiation field intensity. The antenna device with stronger vertical radiation field intensity is suitable to the product requiring stronger intensity in the vertical direction (up-down).

Figure 6A:
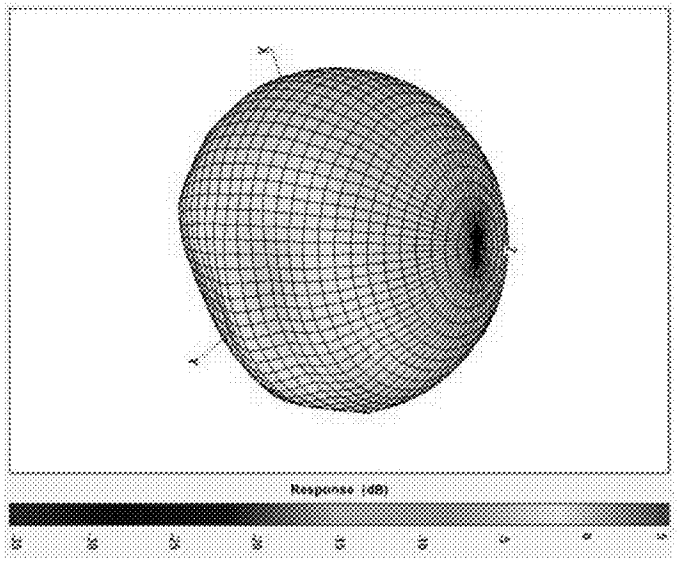
FIG. 6A and FIG. 6B shows a diagram describing performance of frequency response of the antenna device of the present invention.
Figure 6B:
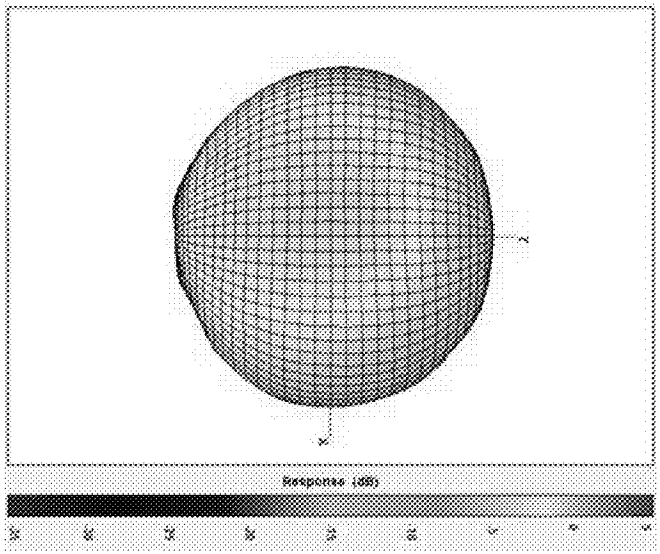

The direction to mount the antenna device 10 influences the frequency response of the antenna. The simulation of the radiation field intensity is shown in FIG. 6A and FIG. 6B. The connectivity between the signaling points of the antenna device 10 renders the signaling direction 503 and causes the fuller and more average intensity, e.g. the frequency response (dB), over the X-Z plane.

Figure 7:
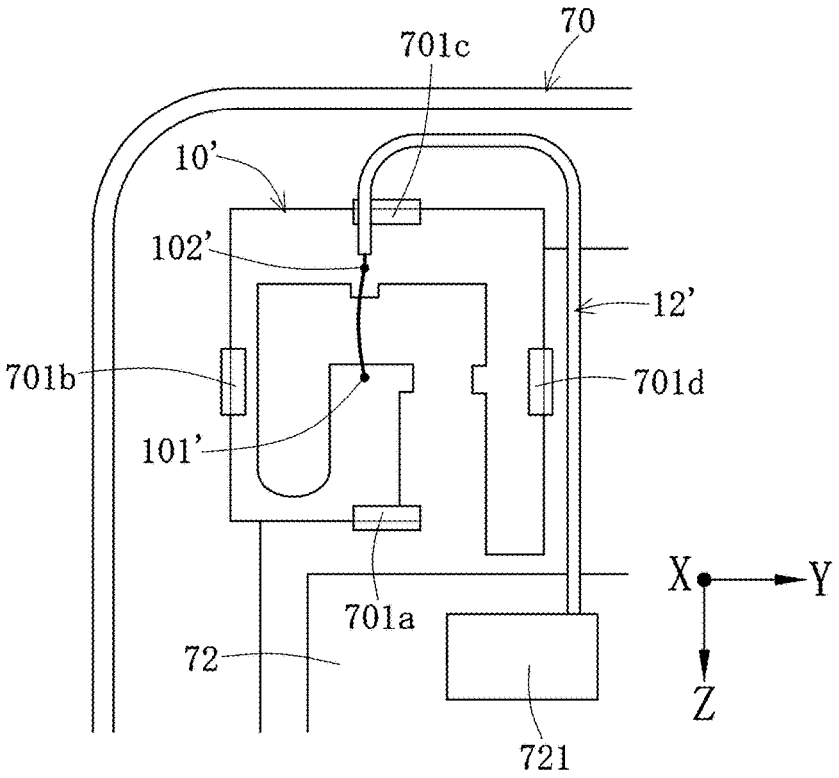
FIG. 7 shows a schematic diagram depicting the antenna device disposed within an apparatus in one embodiment of the present invention.

Reference is next made to FIG. 7. An application system utilizing the antenna device with stronger vertical radiation field intensity is described.

An antenna device 10' with a specific orientation rather than the orientation described in FIG. 4 is shown. The antenna device 10' is mounted within the housing 70 by means of, but not limited to, fixing members 701*a*, 701*b*, 701*c*, and 701*d*. The number of the fixing members may be changed. The clamping member for fixing the antenna device 10' may be disposed at the four corners of the mounting base. The aspect of the present invention allows the antenna device 10' with an aspect ratio of approximately one to one to be adjusted in accordance with need of the electronic device. Using this antenna device 10' with aspect ratio 1:1, the orientation of the antenna device 10' mounted within the electronic device can be easily adjusted as required.

A signal feeding point 101' and a signal grounding point 102' disposed on the antenna device 10' are provided. The surface having the soldering points 101', 102' may be the bottom plane of the antenna device 10 described in FIG. 4. Via the wire 12', the antenna device 10' is electrically connected to a radio-frequency circuit 721 of the circuit board 72. The radio-frequency signals are fed from the signal grounding point 102' to the signal feeding point 101' so as to form a signaling direction. The signal direction renders the radiation field intensity mainly developed over the X-Z plane. This configuration of antenna device is suitable for the product requiring stronger vertical radiation field intensity, such as a network device with the requirement of better vertical radiation field intensity in a vertical space.

In accordance with the present invention, the connection between the signal feeding point and the signal grounding point renders the main development of the radiation field intensity of the antenna device. The orientation of the antenna device with continuous bending structure also leads to the signaling characteristics of the electronic device mounting the antenna device. The examples shown in FIG. 8A through FIG. 8H schematically describe the various signaling directions and the related radiation field intensity.

Figure 8A:
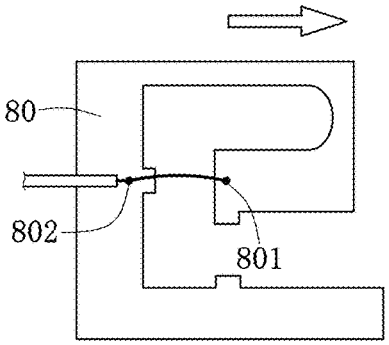
FIG. 8A through FIG. 8H show exemplary patterns of the planar antennas in accordance with the present invention.

FIG. 8A shows a convolution-shaped antenna device 80 formed of a continuous bending extended radiation body. The connectivity between the signal grounding point 802 and the signal feeding point 801 influences the main development of the radiation field intensity of the antenna device 80. The connection between the signal grounding point 802 and the signal feeding point 801 is over a horizontal direction. The main development of the radiation field intensity is also over the horizontal direction, and the antenna device 80 therefore gains better frequency response over the horizontal direction. The wireless communication device having this antenna device 80 provides better radiation coverage over a horizontal space.

Figure 8B:
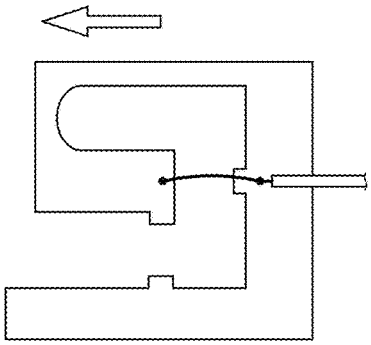

In FIG. 8B, the connectivity between the signal grounding point and the signal feeding point of the antenna device forms a horizontal signaling direction that renders better horizontal development of the radiation field intensity.

Figure 8C:
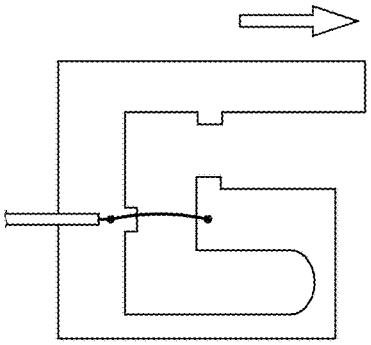
Figure 8D:
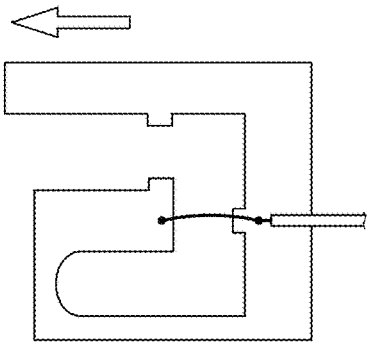

FIG. 8C and FIG. 8D show two antenna devices which are mirror-symmetrical configurations of each other. The connectivity of the signal grounding point and the signal feeding point forms a horizontal signal-feeding direction. The antenna device also has better horizontal radiation field intensity.

Figure 8E:
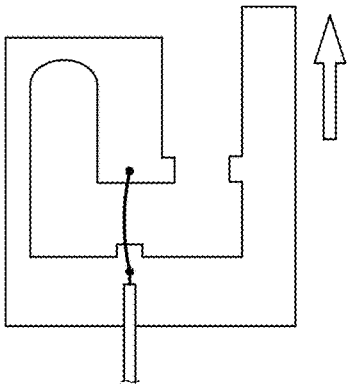
Figure 8F:
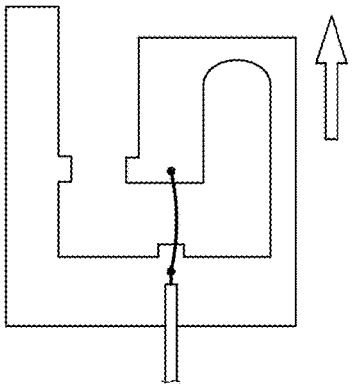
Figure 8G:
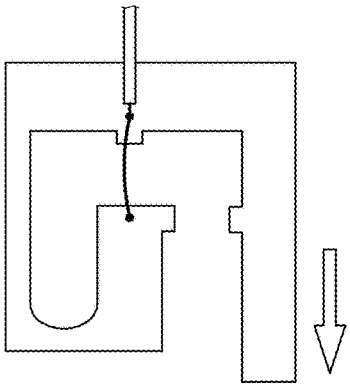
Figure 8H:
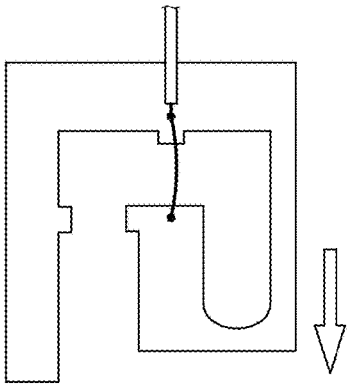

FIG. 8E and FIG. 8F are two mirror-symmetrical antennas of each other. The signaling direction formed by connection between the signal grounding point and the signal feeding point is vertical. The antenna device therefore has better vertical radiation field intensity. Similarly, the antenna device gains better vertical radiation field intensity since the signal-feeding direction is over the vertical direction.

Furthermore, the operating frequency of the antenna device in accordance with the present invention may be adjusted by tuning the signal feeding position or the feeding angle in addition to adjusting the main direction of radiation field intensity of the antenna device. In practice, the operating frequency of the antenna can be changed by tuning the signaling direction from the signal grounding point to the signal feeding point.

Figure 9A:
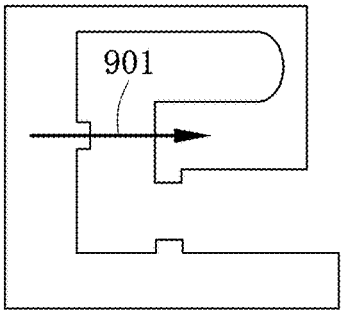
FIG. 9A through FIG. 9E schematically show the signaling directions of the antenna device according to the embodiments of the present invention.
Figure 9B:
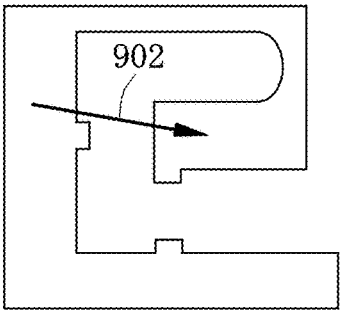
Figure 9C:
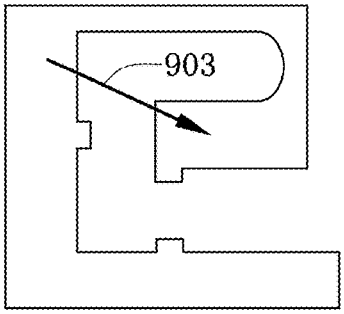
Figure 9D:
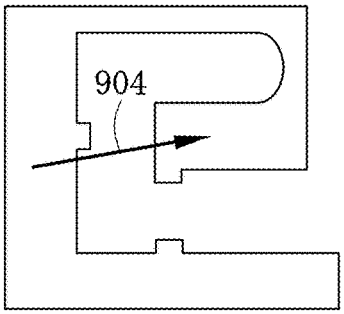
Figure 9E:
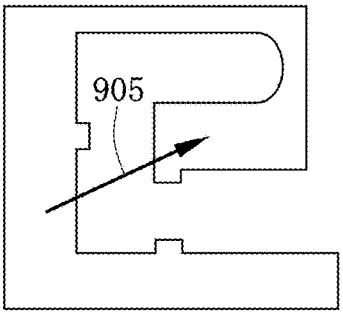

FIG. 9A through FIG. 9E show the various signaling directions of the antenna device. The signaling direction 901 of FIG. 9A, the signaling direction 902 of FIG. 9B, the signaling direction 903 of FIG. 9C, the signaling direction 904 of FIG. 9D, and the signaling direction of FIG. 9E show the variations in angles of the connections between the signal grounding point and the signal feeding point. By changing the signal-feeding direction, the radiation length of the antenna can be tuned for reaching a specific operating frequency.

Figure 10A:
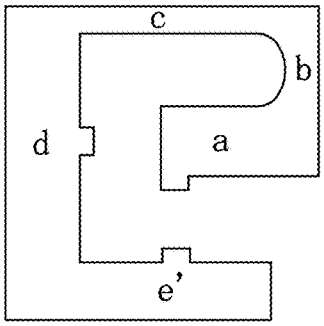
FIG. 10A through FIG. 10D are figures depicting various exemplary types of the antenna device with continuous bending structure of the present invention.
Figure 10B:
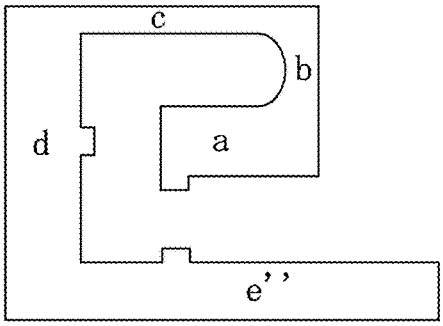
Figure 10C:
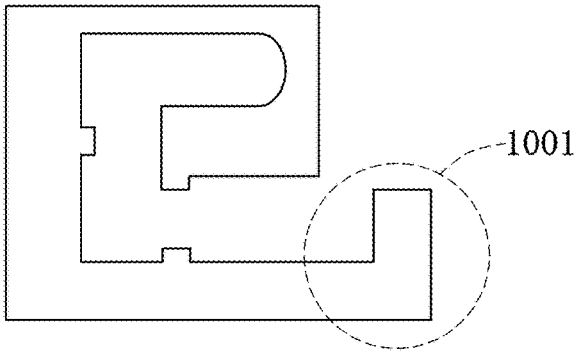

FIG. 10A through FIG. 10C show schematic diagrams describing the structural modifications made to the antenna device in accordance with need.

The main body of the antenna device shown in FIG. 10A is comprised of a radiation member 'a', a second radiation member 'b', a third radiation member 'c', a fourth radiation member 'd' and a radiation member e'. The length of radiation member e' is modified for fitting in with a specific need. It is noted that the configuration of the antenna device is such as the above-described embodiments that requires an aspect ratio of the antenna being approximately 1:1. For example, the ratio of sides of the third radiation member 'c' and the fourth radiation member 'd' of the antenna device maintains about 1:1 for conveniently adjusting its orientation when mounting the antenna device in the electronic device. The adjustable feature of the antenna device allows the antenna device to be adapted to a device requiring horizontal or vertical development of the radiation field intensity. Further, by tuning the position of the signal grounding point, the signal-feeding direction for the antenna device can be adjusted for matching operating frequency. Still further, by modifying the length of the radiation member e', the radiation length of the antenna can also be changed to meet the need of a specific operating frequency.

FIG. 10B shows a longer radiation member e", and the ratio of the other two sides of the antenna device is maintained at about 1:1. Therefore, the antenna device can be adapted to various applications with different development of the radiation field intensity since the orientation of the antenna device is changeable.

FIG. 10C shows one end of the radiation body of the antenna device renders an extended bending structure 1001. Any extension of the radiation body generally fits in with the practical requirements of the operating frequency. The bending structure 1001 can be modified for fitting in with the space in which it is mounted, including its length and the angle.

Figure 10D:
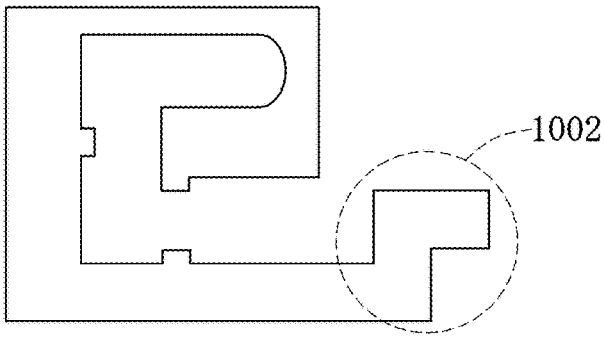

FIG. 10D schematically shows the antenna device having the bending structure 1002 with multiple turning structures for the purpose of a specific operating frequency, and the installation space.

To sum up, the antenna device with continuous bending structure renders the radiation field intensity to be adjustable, including rendering the stronger radiation field intensity with horizontal polarization or vertical polarization. The antenna device can be adaptively modified for fitting in with the applications including adjusting the orientation of the antenna for changing the main development direction of the radiation field intensity, and changing the signal-feeding direction for adjusting the radiation length. The system neither needs any independent ground for the antenna, nor bridging the ground of the system.

It is intended that the specification and depicted embodiment be considered exemplary only, with a true scope of the invention being determined by the broad meaning of the following claims.

What is claimed is:

1. An antenna device with continuous bending structure having an extended radiation body at least comprised of a first radiation member, a second radiation member, a third radiation member, a fourth radiation member, and a fifth radiation member; wherein the first radiation member is not connected with the fifth radiation member, but directed toward the fourth radiation member via the bending structure, and every junction region between every two adjacent radiation members forms the bending structure with consistent bending direction, the antenna device comprising:

a main region, being a radiation body including at least three L-shaped continuous bending structures covering the first radiation member, the second radiation member, the third radiation member and part of the fourth radiation member; a signal grounding point disposed in the fourth radiation member, and a signal feeding point disposed in the first radiation member; wherein the junction region between the first radiation member and the second radiation member has one L-shaped bending structure, the junction region between the second radiation member and the third radiation member has another one L-shaped bending structure, and the junction region between the third radiation member and the fourth radiation member has one more L-shaped bending structure; and a ground region, being another radiation body having at least one L-shaped bending structure, covering the fifth radiation member and another part of the fourth radiation member; the part of the fourth radiation member within the ground region connected with the part of the fourth radiation member covered by the main region; wherein the junction region between the fourth radiation member and the fifth radiation member has one L-shaped bending structure.

2. The antenna device as recited in claim 1, wherein the first radiation member, the third radiation member and the fifth radiation member are parallel with each other; the first radiation member is formed between the third radiation member and the fifth radiation member; and/or the second radiation member and the fourth radiation member are parallel with each other.

3. The antenna device as recited in claim 1, wherein an aspect ratio of two adjacent sides of the planar structure of the antenna device is approximately one to one.

4. The antenna device as recited in claim 3, wherein the two adjacent sides with approximately one to one aspect ratio are respectively the side of the third radiation member and the side of the fourth radiation member.

5. The antenna device as recited in claim 4, wherein the first radiation member, the third radiation member and the fifth radiation member are parallel with each other; the first radiation member is formed between the third radiation member and the fifth radiation member; and/or the second radiation member and the fourth radiation member are parallel with each other.

6. The antenna device as recited in claim 1, wherein the signal feeding point and the signal grounding point are connected via a wire for forming a connectivity as a signal-feeding direction.

7. The antenna device as recited in claim 6, wherein the first radiation member, the third radiation member and the fifth radiation member are parallel with each other; the first radiation member is formed between the third radiation member and the fifth radiation member; and/or the second radiation member and the fourth radiation member are parallel with each other.

8. The antenna device as recited in claim 6, wherein, a radiation field intensity is formed mainly in a horizontal direction when the signal-feeding direction is along the horizontal direction of an electronic device mounting the antenna device; the radiation field intensity is formed mainly in a vertical direction when the signal-feeding direction is along the vertical direction of the electronic device mounting the antenna device.

9. The antenna device as recited in claim 8, wherein the first radiation member, the third radiation member and the fifth radiation member are parallel with each other; the first radiation member is formed between the third radiation member and the fifth radiation member;

and/or the second radiation member and the fourth radiation member are parallel with each other.

10. A application system having an antenna device with continuous bending structure, comprising an electronic device and an antenna device mounted in the electronic device; wherein the antenna device has an extended radiation body comprised of at least a first radiation member, a second radiation member, a third radiation member, a fourth radiation member and a fifth radiation member; the first radiation member is not connected with the fifth radiation member, but directed extensively toward to the fourth radiation member via the bending structure; every junction region between every two adjacent radiation members forms the structures with consistent bending direction; the antenna device comprising:

a main region, being a radiation body including at least three L-shaped continuous bending structures covering the first radiation member, the second radiation member, the third radiation member and part of the fourth radiation member; a signal grounding point disposed in the fourth radiation member, and a signal feeding point disposed in the first radiation member; wherein the junction region between the first radiation member and the second radiation member has one L-shaped bending structure, the junction region between the second radiation member and the third radiation member has another one L-shaped bending structure, and the junction region between the third radiation member and the fourth radiation member has one more L-shaped bending structure; and a ground region, being another radiation body having at least one L-shaped bending structure, covering the fifth radiation member and another part of the fourth radiation member; the part of the fourth radiation member within the ground region connected with the part of the fourth radiation member covered by the main region; wherein the junction region between the fourth radiation member and the fifth radiation member has one L-shaped bending structure.

11. The application system as recited in claim 10, wherein the signal feeding point and the signal grounding point are connected via a wire for forming a connectivity as a signal-feeding direction; a radiation length of the antenna device is changed by adjusting the signaling direction from the signal grounding point to the signal feeding point.

12. The application system as recited in claim 10, wherein an aspect ratio of two adjacent sides of the planar structure of the antenna device is approximately one to one.

13. The application system as recited in claim 12, wherein the signal feeding point and the signal grounding point are connected via a wire for forming a connectivity as a signal-feeding direction; a radiation length of the antenna device is changed by adjusting the signaling direction from the signal grounding point to the signal feeding point.

14. The application system as recited in claim 13, wherein the electronic device has a clamping member for disposing the antenna device with the signal-feeding direction along the horizontal or vertical direction.

* * * * *